US007771012B2

(12) United States Patent
Hosono et al.

(10) Patent No.: US 7,771,012 B2
(45) Date of Patent: Aug. 10, 2010

(54) LIQUID EJECTING HEAD AND LIQUID EJECTING APPARATUS

(75) Inventors: Satoru Hosono, Azumino (JP); Fujio Akahane, Azumino (JP); Ryoichi Tanaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/126,618

(22) Filed: May 23, 2008

(65) Prior Publication Data

US 2008/0297561 A1 Dec. 4, 2008

(30) Foreign Application Priority Data

May 31, 2007 (JP) ..... 2007-144931
Jan. 10, 2008 (JP) ..... 2008-003218

(51) Int. Cl.
*B41J 2/15* (2006.01)
*B41J 2/145* (2006.01)

(52) U.S. Cl. ..... 347/40
(58) Field of Classification Search ..... 347/40–43, 347/47, 49, 9, 12, 20, 44
See application file for complete search history.

(56) References Cited

U.S. PATENT DOCUMENTS 4,901,093 A * 2/1990 Ruggiero et al. ..... 347/70
6,276,057 B1 * 8/2001 Aihara et al. ..... 29/890.1
6,922,203 B2 * 7/2005 Giere et al. ..... 346/65

FOREIGN PATENT DOCUMENTS

JP 2002-103619 4/2002
JP 2003-080700 3/2003
JP 2006-068941 3/2006
JP 2006-305948 11/2006
JP 2007-090750 4/2007

* cited by examiner

*Primary Examiner*—Thinh H Nguyen
(74) *Attorney, Agent, or Firm*—Workman Nydegger

(57) ABSTRACT

A liquid ejecting head includes a plurality of nozzle groups each including a plurality of nozzle openings; and a plurality of pressure generating chambers that cause liquid to be ejected from the nozzle openings. A plurality of recessed portions are formed at a nozzle forming member, the recessed portions each having a thickness smaller than a thickness of the nozzle forming member, the nozzle openings being formed at the recessed portions. A set of at least one of the plurality of nozzle openings included in each single nozzle group defines a nozzle set, the nozzle set being arranged to correspond to each of the pressure generating chambers. The nozzle groups each have a plurality of nozzle sets in an array, the nozzle sets of one of the nozzle groups being relatively shifted from the nozzle sets of another one of the nozzle groups in a nozzle-set-array direction.

10 Claims, 10 Drawing Sheets

LIQUID EJECTING HEAD AND LIQUID EJECTING APPARATUS

BACKGROUND

1. Technical Field

The present invention relates generally to liquid ejecting heads such as ink jet recording heads, and to liquid ejecting apparatuses, and more particularly to a liquid ejecting head including a plurality of nozzle groups in which nozzle openings are arranged, and pressure generating chambers communicating with the nozzle openings, the liquid ejecting head causing a pressure variation to be generated in liquid in a pressure generating chamber so as to eject the liquid from a nozzle opening corresponding to the pressure generating chamber, and to a liquid ejecting apparatus having the liquid ejecting head.

2. Related Art

A liquid ejecting apparatus includes a liquid ejecting head capable of ejecting liquid, and ejects various kinds of liquid from the liquid ejecting head. For example, a typical liquid ejecting apparatus may be an image recording apparatus such as an ink jet printer. The ink jet printer includes an ink jet recording head (hereinafter, merely referred to as recording head) as a liquid ejecting head, and performs printing by ejecting liquid-state ink, which is in the form of ink droplets, from nozzle openings of the recording head to allow the ink droplets to land on a recording medium (ejection target) such as a recording sheet. In recent years, a liquid ejecting apparatus is applied to not only the image recording apparatus, but also various kinds of manufacturing apparatuses, such as a color filter manufacturing apparatus for color filters of, for example, liquid crystal displays.

In the ink jet printer (hereinafter, merely referred to as printer), ink droplets are ejected by applying an ejection pulse, from a driving signal containing a series of ejection pulses, selectively to a pressure generating unit (for example, a piezoelectric vibrator, which is an electromechanical converter, or a heating element, which is an electrothermal converter); driving the pressure generating unit; causing a pressure variation to be generated in ink in a pressure generating chamber; and controlling the pressure variation (for example, see JP-A-2002-103619).

Meanwhile, such a printer is demanded to record an image or the like efficiently with a reduced amount of ink. In particular, when an image is to be recorded on a recording sheet, a deformation (roughness) may be generated at a recording sheet because of moisture contained in ink, or an ink bleed may be found at a recorded image. Hence, a total amount of ink landing on a recording sheet is preferably reduced as much as possible. Also, if ink in an ink cartridge is consumed quickly, the ink cartridge has to be frequently replaced, thereby increasing the running cost, which is a burden to a user, and providing an adverse effect on the environmental conservation.

SUMMARY

An advantage of some aspects of the invention is to provide a liquid ejecting apparatus capable of efficiently filling an area on an ejection target with dots using a reduced amount of liquid.

According to an aspect of the invention, a liquid ejecting head includes a plurality of nozzle groups each including a plurality of nozzle openings; and a plurality of pressure generating chambers that cause liquid to be ejected from the nozzle openings. A plurality of recessed portions are formed at a nozzle forming member, the recessed portions each having a thickness smaller than a thickness of the nozzle forming member, the nozzle openings being formed at the recessed portions. A set of at least one of the plurality of nozzle openings included in each single nozzle group defines a nozzle set, the nozzle set being arranged to correspond to each of the pressure generating chambers. The nozzle groups each have a plurality of nozzle sets in an array, the nozzle sets of one of the nozzle groups being relatively shifted from the nozzle sets of another one of the nozzle groups in a nozzle-set-array direction.

With the configuration, since the set of the at least one, for example, two of the plurality of nozzle openings of the single nozzle group defines the nozzle set, and the nozzle set is arranged to correspond to each of the pressure generating chambers, the liquid can be ejected simultaneously from the nozzle openings of the nozzle set corresponding to one of the pressure generating chambers of a driving target by a single ejection operation. Hence, a predetermined area on an ejection target can be efficiently filled with dots using the liquid ejected from the nozzle openings by an amount of ink smaller than that of a related art. Accordingly, liquid consumption can be reduced as compared with the related art. As a result, for example, a deformation of a recording sheet because of moisture, or an ink bleed of a recorded image can be prevented. Also, since the liquid consumption is reduced, the running cost can be reduced and a contribution to the environmental conservation can be made.

Also, the nozzle sets of one of the nozzle groups are relatively shifted from the nozzle sets of another one of the nozzle groups in the nozzle-set-array direction. Accordingly, if it is difficult to reduce a width of the pressure generating chamber in the nozzle-set-array direction due to the manufacturing requirement, or if it is difficult to arrange the nozzle sets of the single nozzle group at even intervals in the nozzle-set-array direction, dots can be formed on a line at a constant interval in the nozzle-set-array direction merely by varying ejection timings between the first nozzle group and the second nozzle group without increasing the number of scanning operations (paths). This arrangement can make a contribution to an increase in liquid-ejecting processing speed such as a recording speed.

In the above-described aspect, it is preferable that the nozzle openings defining the single nozzle set are arranged obliquely to the nozzle-set-array direction.

With this configuration, since the nozzle openings defining the single nozzle set are arranged obliquely to the nozzle-set-array direction, an interval of the nozzle opening of the single nozzle set can be increased without changing the arrangement interval of the nozzle openings in the nozzle-set-array direction from a regular interval (for example, a design value of a dot forming density). Accordingly, the nozzle openings can be further easily formed by pressing.

Also, since the interval of the nozzle openings of the single nozzle set is increased, an adverse effect caused by the close arrangement of the ejected liquid can be prevented. Thus, a flying bend of the liquid when the liquid is ejected from the nozzle openings can be reduced.

Further, when the liquid is ejected from the nozzle openings of the single nozzle set, two dots are formed on the ejection target such as a recording sheet obliquely to the nozzle-set-array direction. As described above, since the dots are formed obliquely, a predetermined area can be covered with dots evenly in the nozzle-set-array direction and a direction orthogonal thereto.

In the aspect, it is preferable that an arrangement direction of the nozzle openings defining the single nozzle set is at an angle of 45° to the nozzle-set-array direction.

With this configuration, since the nozzle openings defining the single nozzle set are at the angle of 45° to the nozzle-set-array direction, the interval of the nozzle openings can be maximized in a minimum space.

In the above aspect, it is preferable that a shift amount between the nozzle sets of one of the nozzle groups and the nozzle sets of another one of the nozzle groups is ½ of an arrangement interval P of the nozzle sets of the nozzle groups.

It is noted that the "arrangement interval of the nozzle sets" represents a distance from the center of the nozzle set to the center of the adjacent nozzle set.

In the above aspect, it is preferable that an arrangement interval of the nozzle openings defining the single nozzle set in the nozzle-set-array direction is P/n, where n is a natural number.

Also, it is preferable that n=4.

Further, it is preferable that each of the recessed portions is provided for each of the nozzle sets so as to contain the nozzle openings defining the single nozzle set.

With the configuration, a bottom portion of the recessed portion has the thickness smaller than the thickness of the peripheral portion of the bottom portion. The nozzle openings are bored at the bottom portion of the recessed portion, and hence, a load to a male die (punch) used for plastic working can be reduced. Thus, the mail die can be prevented from buckling. Also, the recessed portion is shared by the nozzle openings defining the single nozzle set, the working can be easily performed in comparison with a case where a recessed portion is formed for each nozzle opening. In addition, a sufficient intensity of the punch can be provided.

In the above aspect, alternatively, each of the recessed portions may be preferably provided individually for each of the nozzle openings.

With the configuration, since the recessed portion is provided individually for each nozzle opening, the nozzle openings have a uniform peripheral shape. Accordingly, a flying bend of liquid ejected from the nozzle openings can be reduced.

Further, it is preferable that the liquid ejection head further includes a pressure generating unit that generates a pressure variation in the liquid in each of the pressure generating chambers. The pressure generating unit may be preferably an electromechanical converter or an electrothermal converter.

According to another aspect of the invention, a liquid ejecting apparatus includes the liquid ejecting head according to the above-described aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
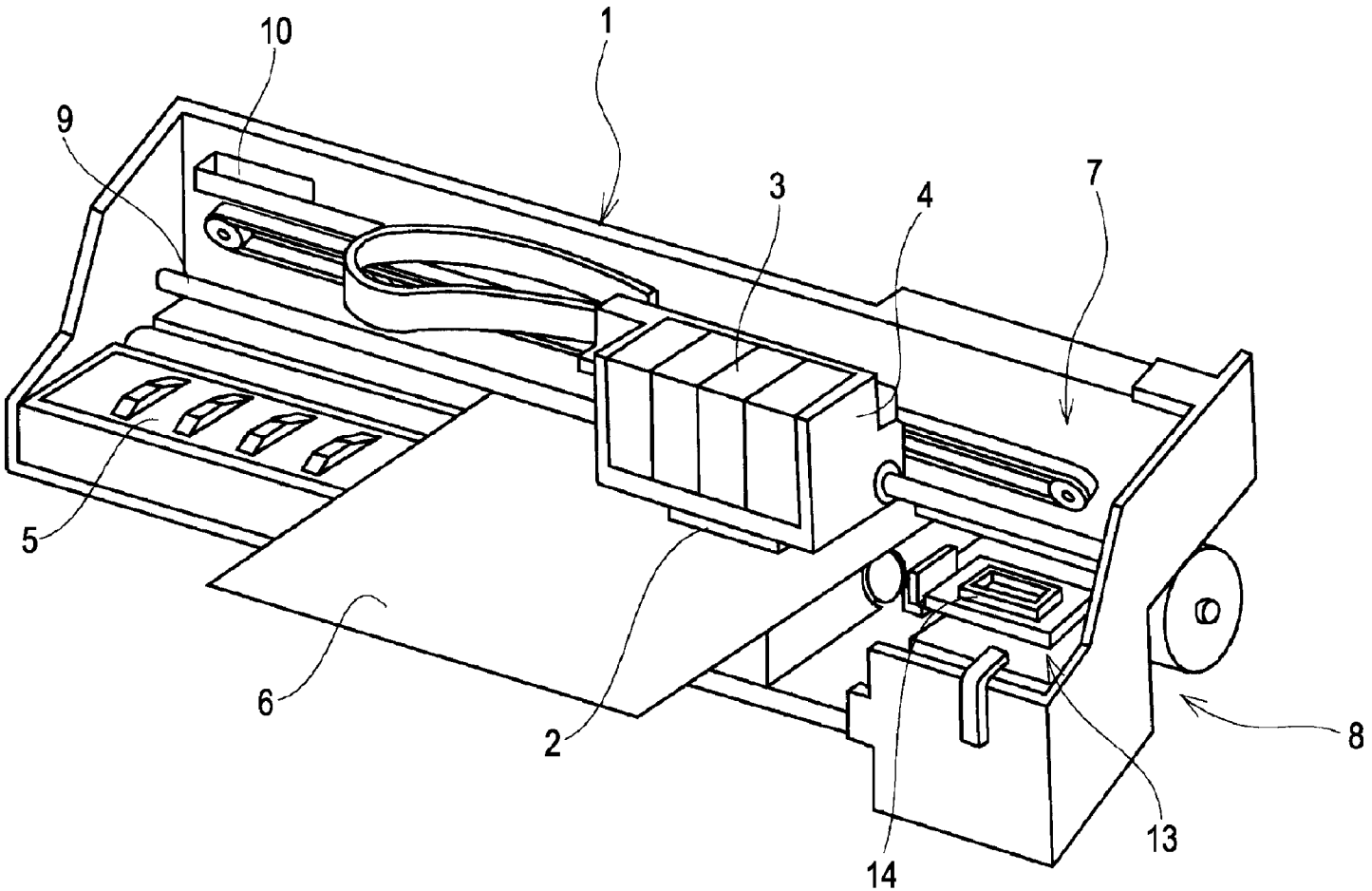
FIG. 1 is a perspective view showing a configuration of a printer according to an embodiment of the invention.

Preferred embodiments for implementing the invention are described below with reference to the attached drawings. Embodiments described below have various limitations as preferred aspects of the invention. However, the scope of the invention should not be limited to these aspects unless a limitation of the invention is particularly stated in the description. In the following description, an ink jet printer (hereinafter, merely referred to as printer) in FIG. 1 is described as an embodiment of a liquid ejecting apparatus of the invention.

A printer 1 generally includes a carriage 4, a platen 5, a carriage moving mechanism 7, a sheet feeding mechanism 8, and the like. A recording head 2, which is a kind of liquid ejecting head, is mounted at the carriage 4, and an ink cartridge 3 is removably mounted at the carriage 4. The platen 5 is arranged below the recording head 2. The carriage moving mechanism 7 moves the carriage 4 with the recording head 2 mounted, in a sheet-width direction of a recording sheet 6 (ejection target). The sheet feeding mechanism 8 transports the recording sheet 6 in a sheet-feeding direction which is orthogonal to the sheet-width direction. Herein, the sheet-width direction is a main-scanning direction (head scanning direction), and the sheet-feeding direction is a sub-scanning direction (that is, a direction orthogonal to the head scanning direction). The ink cartridge 3 may be a type to be mounted on the carriage 4, or a type to be mounted to a portion of a case of the printer 1 so as to supply the recording head 2 with ink through an ink supply tube.

The carriage 4 is supported by a guide rod 9 extending in the main-scanning direction, so that the carriage 4 is moved in the main-scanning direction along the guide rod 9 by an operation of the carriage moving mechanism 7. The position of the carriage 4 in the main-scanning direction is detected by a linear encoder 10. A detected signal, as position information, is transmitted to a printer controller 12 (see FIG. 4). Accordingly, the printer controller 12 can control a recording operation (ejection operation) and the like of the recording head 2 while the printer controller 12 recognizes a scanning position of the carriage 4 (recording head 2) on the basis of the position information from the linear encoder 10.

A home position, which is a scanning start point of the recording head 2, is provided within a movable range of the recording head 2 at a position outside the platen 5. A capping mechanism 13 is provided at the home position. The capping mechanism 13 seals a nozzle surface of the recording head 2 with a cap member 14, so as to prevent a solvent of ink from being evaporated from nozzle openings 15 (see FIG. 2). The capping mechanism 13 is also used for a cleaning operation by applying a negative pressure to the sealed nozzle surface and forcibly sucking and removing the ink from the nozzle openings 15.

Figure 2:
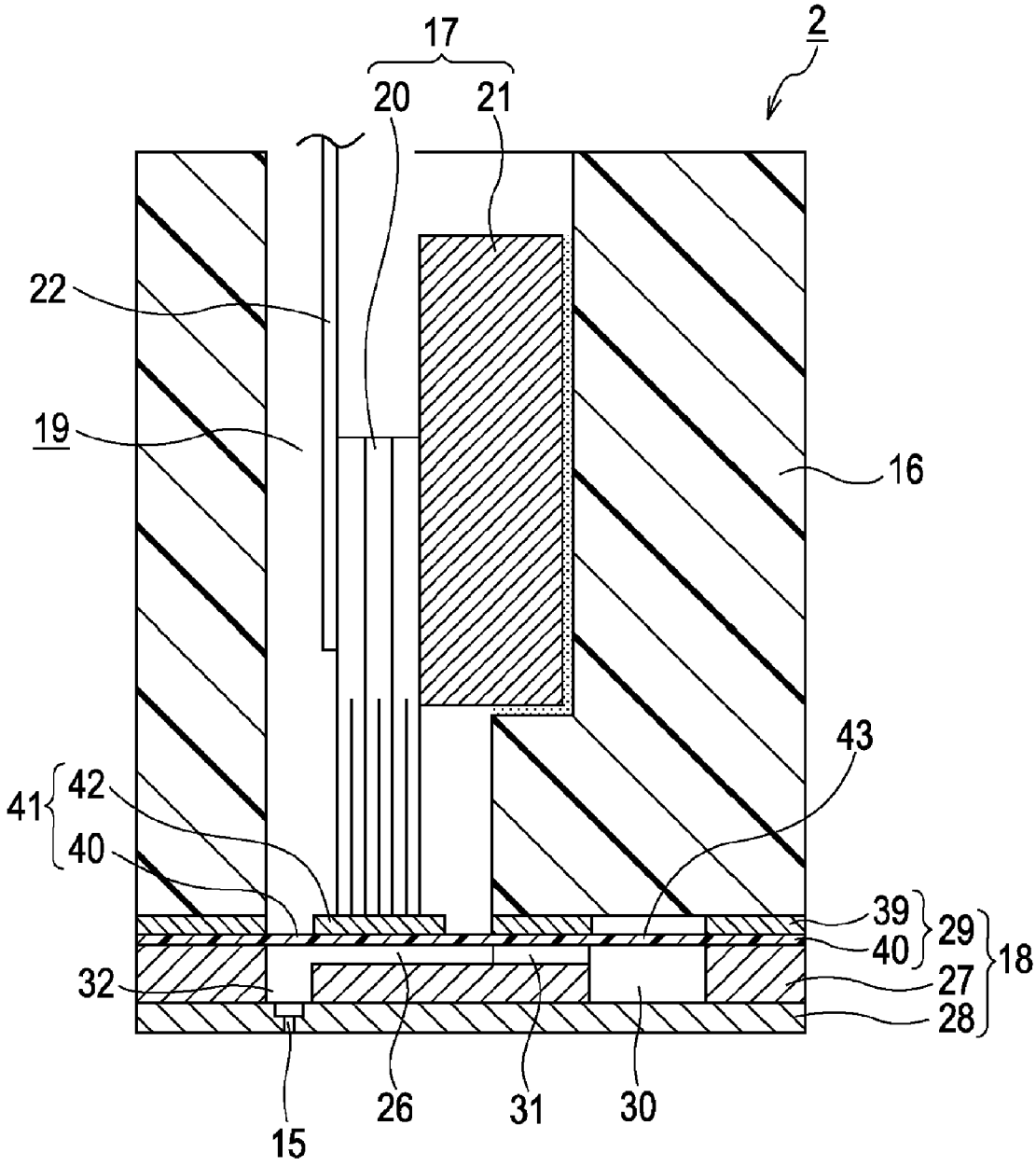
FIG. 2 is a cross section showing a primary portion of a configuration of a recording head.

FIG. 2 is a cross section showing a primary portion of a configuration of the recording head 2. The recording head 2 includes a head case 16, an actuator unit 17 housed in the head case 16, and a passage unit 18 bonded to a bottom surface (tip end surface) of the head case 16. The head case 16 is, for example, made of epoxy resin. The head case 16 has therein a housing hollow portion 19 to house the actuator unit 17. The actuator unit 17 has a plurality of piezoelectric vibrators 20 (each of which corresponds to a pressure generating unit and is a kind of electromechanical converter) being divided into comb-like shapes, and a fixing plate 21 to which the piezoelectric vibrators 20 are bonded. Each of the piezoelectric vibrators 20 is connected to a flexible cable 22, so as to receive a driving signal supplied from the driving signal generating circuit 24 (see FIG. 4) through the flexible cable 22.

The piezoelectric vibrators 20 according to this embodiment each are a piezoelectric vibrator of so-called length-extension vibration mode. The piezoelectric vibrator is displaced (expanded or contracted) in a direction orthogonal to a lamination direction of a piezoelectric substance and an electrode when a driving signal is supplied to the piezoelectric vibrator. The piezoelectric vibrators 20 are divided into the comb-like shapes at a pitch equivalent to a formation pitch of the pressure generating chambers 26 of the passage unit 18. The piezoelectric vibrators 20 correspond to the pressure generating chambers 26 one by one.

Figure 3:
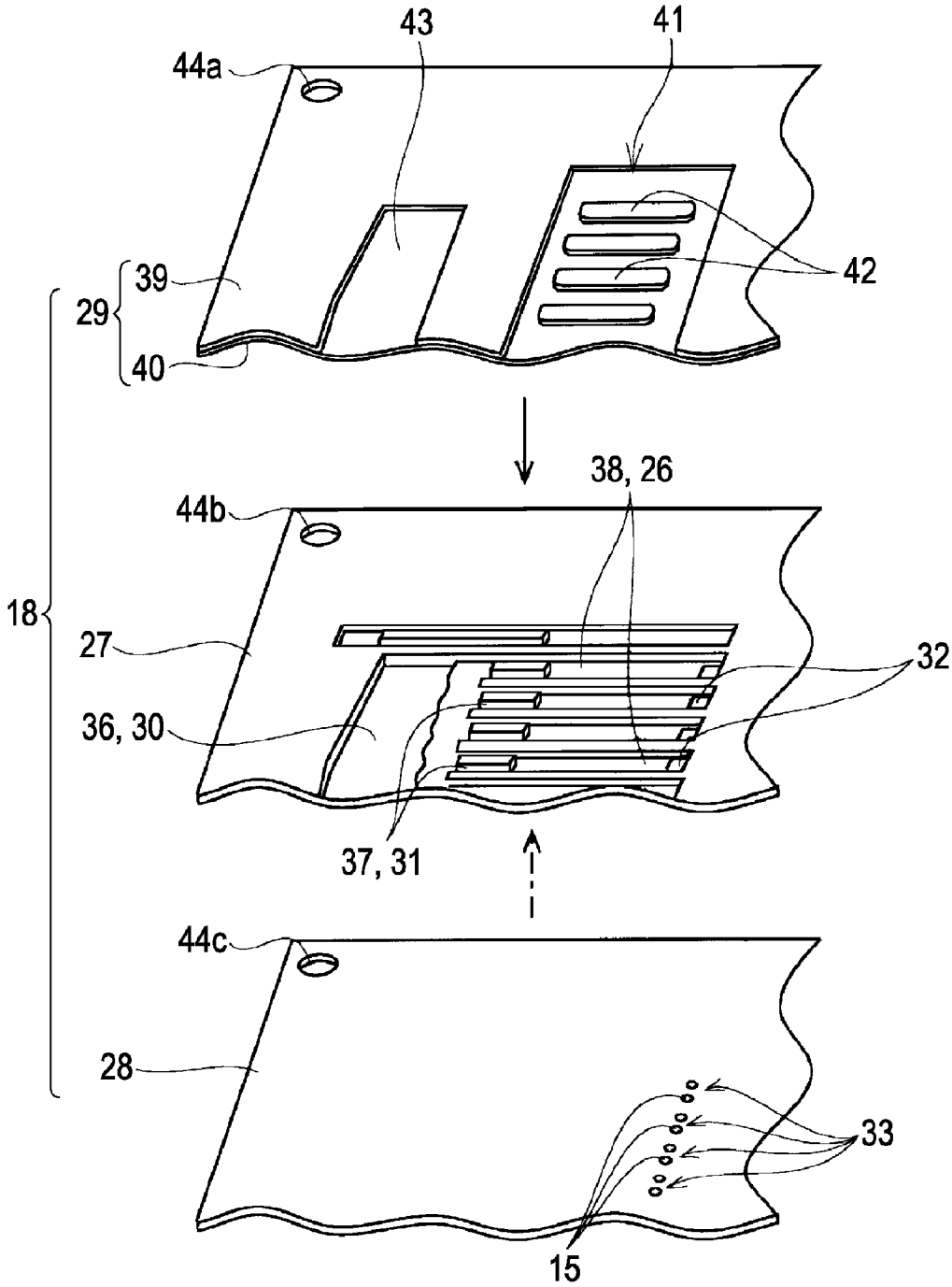
FIG. 3 is an exploded perspective view showing a configuration of a passage unit.

FIG. 3 is an exploded perspective view showing a configuration of the passage unit 18 according to the embodiment. The passage unit 18 is fabricated by bonding a nozzle plate 28 (a kind of nozzle forming member) on one side of a pressure chamber forming substrate 27, and bonding a vibrating plate 29 on the other side of the pressure chamber forming substrate 27, so as to be integrally formed. As shown in FIG. 2, the passage unit 18 forms a continuous ink passage extending from a reservoir 30 to an ink supply port 31, a pressure generating chamber 26, a nozzle communicating opening 32, and then to the nozzle opening 15.

The nozzle plate 28 is a metal thin plate in which a plurality of nozzle openings 15 are bored in an array in the sub-scanning direction. In this embodiment, the nozzle plate 28 is made of a stainless plate member, and has a plurality of arrays (nozzle groups) of the nozzle openings 15, in particular, two arrays of the nozzle openings 15 are provided. A nozzle group includes, for example, 360 nozzle openings 15 arranged in an array. A nozzle set 33 is a set of a plurality of nozzle openings 15 contained in the single nozzle group, for example, a set of two nozzle openings 15 being adjacent to each other in the sub-scanning direction. Nozzle sets 33 are arranged at 180 dots per inch (dpi) in the sub-scanning direction to correspond to the pressure generating chambers 26 (hollow portions 38 of the pressure chamber forming substrate 27) one by one. Thus, in this embodiment, a nozzle set 33, or two nozzle openings 15, correspond to a pressure generating chamber 26.

Figure 6:
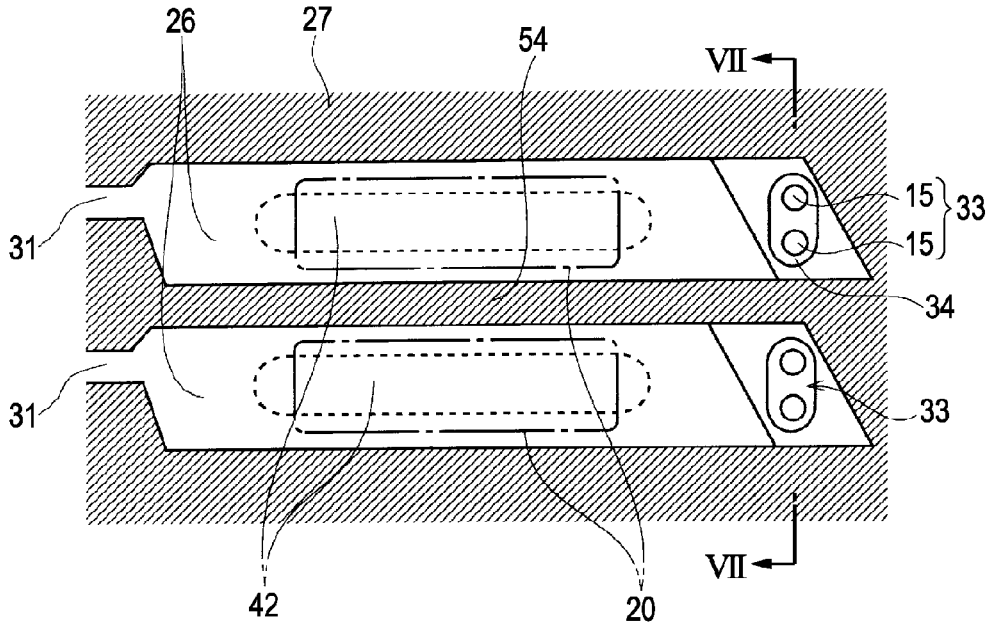
FIG. 6 is a plan view showing a configuration of a passage forming substrate according to a first embodiment of the invention.
Figure 7:
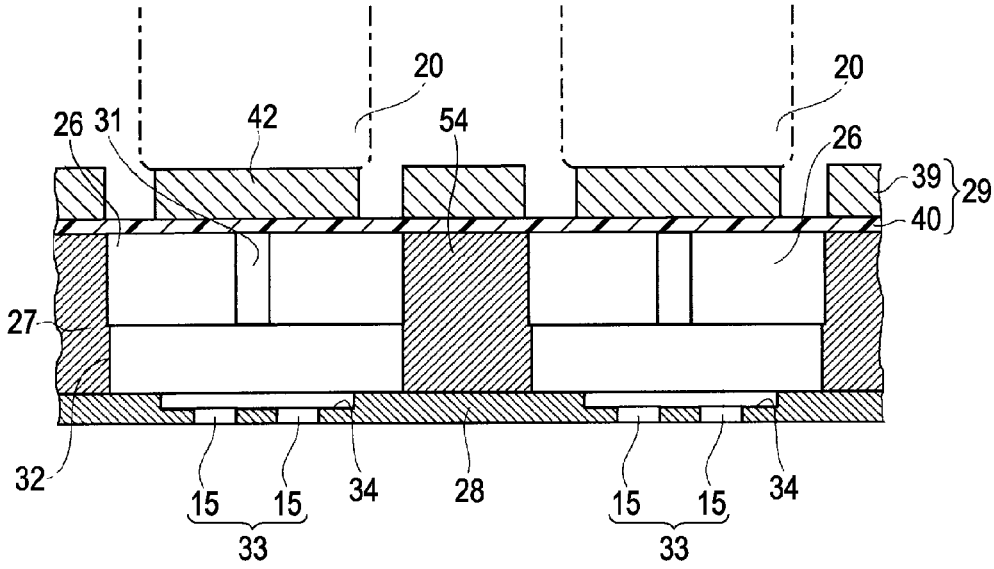
FIG. 7 is a cross section taken along line VII-VII in FIG. 6.

As shown in FIGS. 6 and 7, in this embodiment, the nozzle plate 28 is recessed to an intermediate position in a thickness direction of the nozzle plate 28 so as to form a recessed portion 34 (second nozzle) having an ellipsoidal shape in plan view. The recessed portion 34 is shared by the nozzle openings 15 defining the single nozzle set 33. The nozzle openings 15 are bored at a bottom portion of the recessed portion 34. That is, the recessed portion 34 includes the nozzle openings 15 defining the single nozzle set 33. The bottom portion of the recessed portion 34 has a thickness smaller than a peripheral portion of the bottom portion. If the nozzle openings 15 are bored at the bottom portion of the recessed portion 34, a load to a male die (punch) used during plastic working for boring the nozzle openings 15 can be reduced, and hence, the mail die can be prevented from buckling or the like. Also, the recessed portion 34 is shared by the nozzle openings 15 defining the single nozzle set 33, the working can be easily performed in comparison with a case where a recessed portion is formed individually for each nozzle opening. In addition, a sufficient intensity of the punch for forming the nozzle openings 15 can be provided.

Nozzle groups are arranged at the nozzle plate 28 such that nozzle sets 33 of a first nozzle group (one of the nozzle groups) are relatively shifted from nozzle sets 33 of a second nozzle group (another one of the nozzle groups) in a nozzle-set-array direction. Such an arrangement is described later in more detail.

The pressure chamber forming substrate 27 arranged between the nozzle plate 28 and the vibrating plate 29 is a portion to be an ink passage, and more particularly, a plate member divided into an opening 36 serving as a reservoir 30, groove portions 37 serving as ink supply ports 31, and hollow portions (pressure chamber hollow portions) 38 serving as pressure generating chambers 26. In this embodiment, the member is fabricated by performing anisotropic etching for a silicon wafer which is a base material having a crystallizability. The hollow portions 38 are long recessed portions extending in the main-scanning direction. One end of each hollow portion 38 communicates with the opening 36 via a corresponding groove portion 37. The other end of each hollow portion 38 communicates with the nozzle openings 15 of the nozzle plate 28 via a corresponding nozzle communicating opening 32. The hollow portions 38 are arranged at the pressure chamber forming substrate 27 in a plurality of arrays in the sub-scanning direction.

The vibrating plate 29 is made of a composite plate member formed by laminating a polyphenylene sulfide (PPS) resin film, as an elastic thin-film portion 40, on a surface of a supporting plate 39 made of metal such as stainless steel. The vibrating plate 29 has a diaphragm portion 41. The diaphragm portion 41 is deformed in accordance with expansion and contraction of the piezoelectric vibrators 20 to cause a pressure variation to be generated in ink (a kind of liquid) contained in the pressure generating chambers 26. The diaphragm portion 41 is formed by removing an area of the supporting plate 39 by etching so that only the elastic thin-film portion 40 is left in the area while portions of the supporting plate 39 to be connected to the tip end surfaces of the piezoelectric vibrators 20 are remained unremoved to define island portions 42.

The vibrating plate 29 also has a compliance portion 43 that seals one of opening surfaces of the opening 36 of the pressure chamber forming substrate 27 to divide a portion of the reservoir 30. The compliance portion 43 is formed by removing an area of the supporting plate 39 corresponding to the reservoir 30 (opening 36) by etching so that only the elastic thin-film portion 40 is left in the area. The compliance portion 43 serves as a damper that reduces a pressure variation in ink contained in the reservoir 30 during driving of the piezoelectric vibrators 20.

The above-described passage unit forming members, namely, the vibrating plate 29, the pressure chamber forming substrate 27, and the nozzle plate 28 respectively have reference holes 44 (44*a*, 44*b*, 44*c*) penetrating through these plates in a plate thickness direction. Positioning pins (not shown) can be inserted to the reference holes 44. The passage unit forming members are relatively aligned by inserting the positioning pins to the reference holes 44, and then the members are bonded with an adhesive. The passage unit forming members are fixed to the head case 16 with the nozzle plate 28 facing downward.

Figure 4:
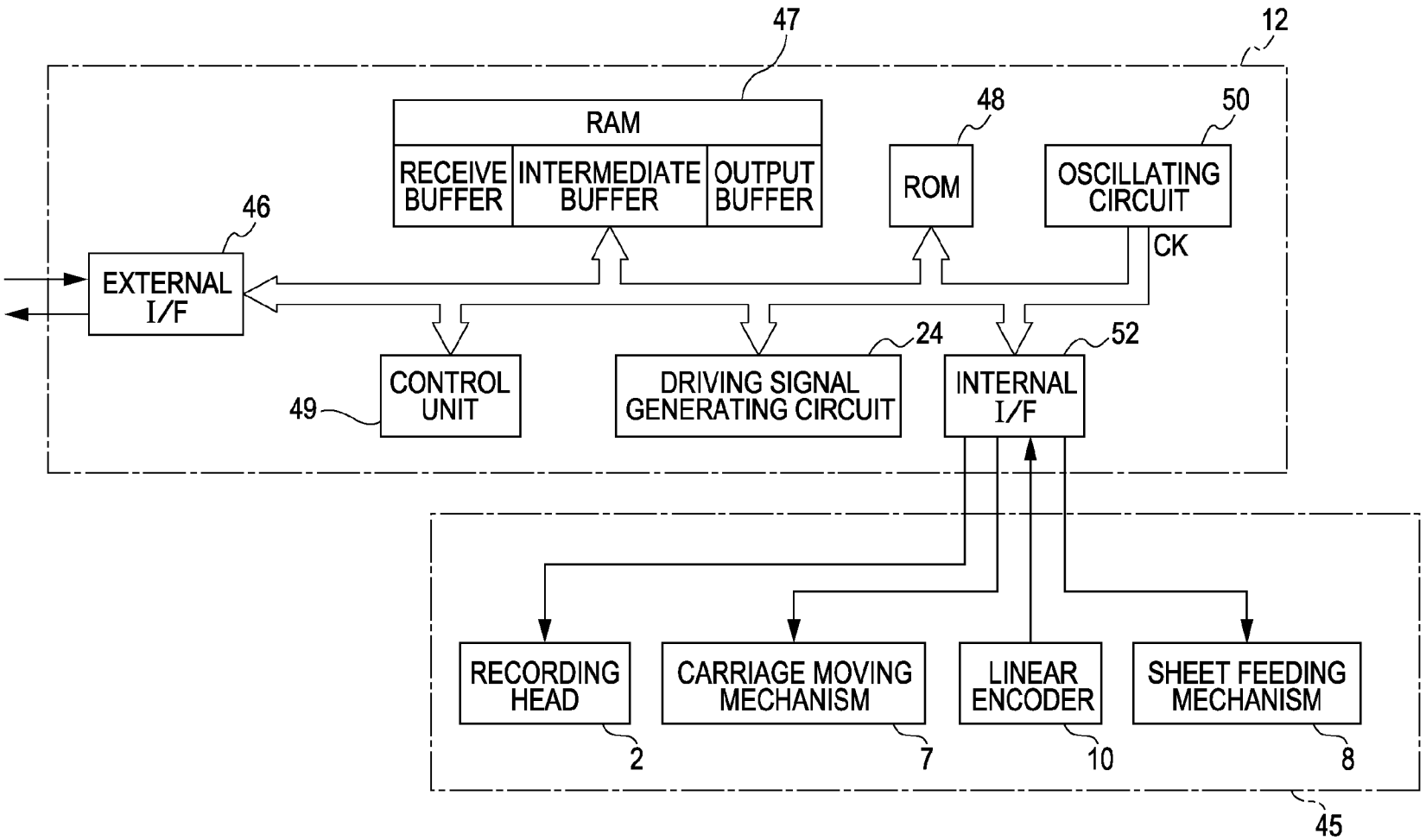
FIG. 4 is a block diagram showing an electrical configuration of a printer.

FIG. 4 is a block diagram showing an electrical configuration of a printer. The printer 1 according to the embodiment generally includes the printer controller 12 and a print engine 45. The printer controller 12 includes an external interface (external I/F) 46 that receives print data and the like input from an external device such as a host computer; a RAM 47 serving as a work memory that temporarily stores various data; a ROM 48 that stores a control program for various data processing, font data, a graphic function, and the like; a control unit 49 that controls the components; an oscillating circuit 50 that generates a clock signal; the driving signal generating circuit 24 that generates a driving signal to be supplied to the recording head 2; and an internal interface (internal I/F) 52 that outputs ejection data, a driving signal, and the like, obtained by developing print data for a dot.

The control unit 49 performs an integrated control for the above-mentioned components on the basis of the control program stored in the ROM 48, and converts print data received from the external device through the external I/F 46 into ejection data (dot pattern data) to be used by the recording head 2. When the control unit 49 has acquired ejection data for a line recordable by a single main scanning of the recording head 2, the control unit 49 outputs the ejection data for a line stored in an output buffer to the recording head 2 via the internal I/F 52.

The print engine 45 includes the recording head 2, the carriage moving mechanism 7, the sheet feeding mechanism 8, and the linear encoder 10. The carriage moving mechanism 7 includes the carriage 4 with the recording head 2 mounted, and a driving motor that allows the carriage 4 to travel by using a timing belt or the like. The carriage moving mechanism 7 moves the recording head 2 in the main-scanning direction. The sheet feeding mechanism 8 includes a sheet feeding motor and a sheet feeding roller. The sheet feeding mechanism 8 continuously feeds the recording sheet 6 for sub-scanning. The linear encoder 10 outputs an encoder pulse corresponding to a scanning position of the recording head 2 mounted at the carriage 4, as position information in the main-scanning direction, to the control unit 49 via the internal I/F 52.

The above-described driving signal generating circuit 24 generates a series of driving signals containing a plurality of ejection pulses (ejection waveforms). The ejection pulses allow the piezoelectric vibrators 20 to be expanded or contracted so that ink droplets are ejected from the nozzle openings 15. A driving signal COM shown in FIG. 5 contains two ejection pulses (first ejection pulse P1, second ejection pulse P2) within a single recording period T. The driving signal generating circuit 24 repeatedly generates a driving signal COM every recording period T. The ejection pulses P1 and P2 have signals with the same waveform. Such a signal includes an expansion element p1 increasing a potential from a midpoint potential VM to a high potential VH at a constant gradient inhibiting ink droplets from being ejected; an expansion hold element p2 holding the high potential VH for a given period of time; an ejection element p3 decreasing a potential from the high potential VH to a low potential VL at a steep gradient; a contraction hold element p4 holding the low potential VL for a given period of time; and a damping element p5 recovering a potential from the low potential VL to the midpoint potential VM.

In a case where the ejection pulses P1 and P2 are to be supplied to the piezoelectric vibrator 20, ink droplets by a regular amount are ejected simultaneously from the two nozzle openings 15 defining the single nozzle set 33 every time when each of the ejection pulses P1 and P2 is supplied. In this embodiment, the amount of ink droplet to be ejected from a nozzle opening 15 is 5 pl. In particular, by applying an ejection pulse to the piezoelectric vibrator 20, an ink droplet is ejected from each nozzle opening 15 of the corresponding pressure generating chamber 26 by 5 pl, that is, ink droplets are simultaneously ejected from two nozzle openings 15 by the total of 10 pl.

When the printer 1 forms a unit pixel on a recording medium such as a recording sheet, an ink droplet is continuously ejected by using the first ejection pulse P1 and the second ejection pulse P2. Accordingly, a plurality of ink droplets may land on the recording sheet 6 in the main-scanning direction. In this embodiment, a design resolution of a unit pixel (design value of a basic resolution or a dot forming density) is determined as follows: vertical direction (sub-scanning direction)×horizontal direction (main-scanning direction)=360×360 dpi (=70×70 μm). That is, dots are formed by ink droplets landing on an area having the above size, and the area is filled with the dots, so as to form a unit pixel.

Figure 8:
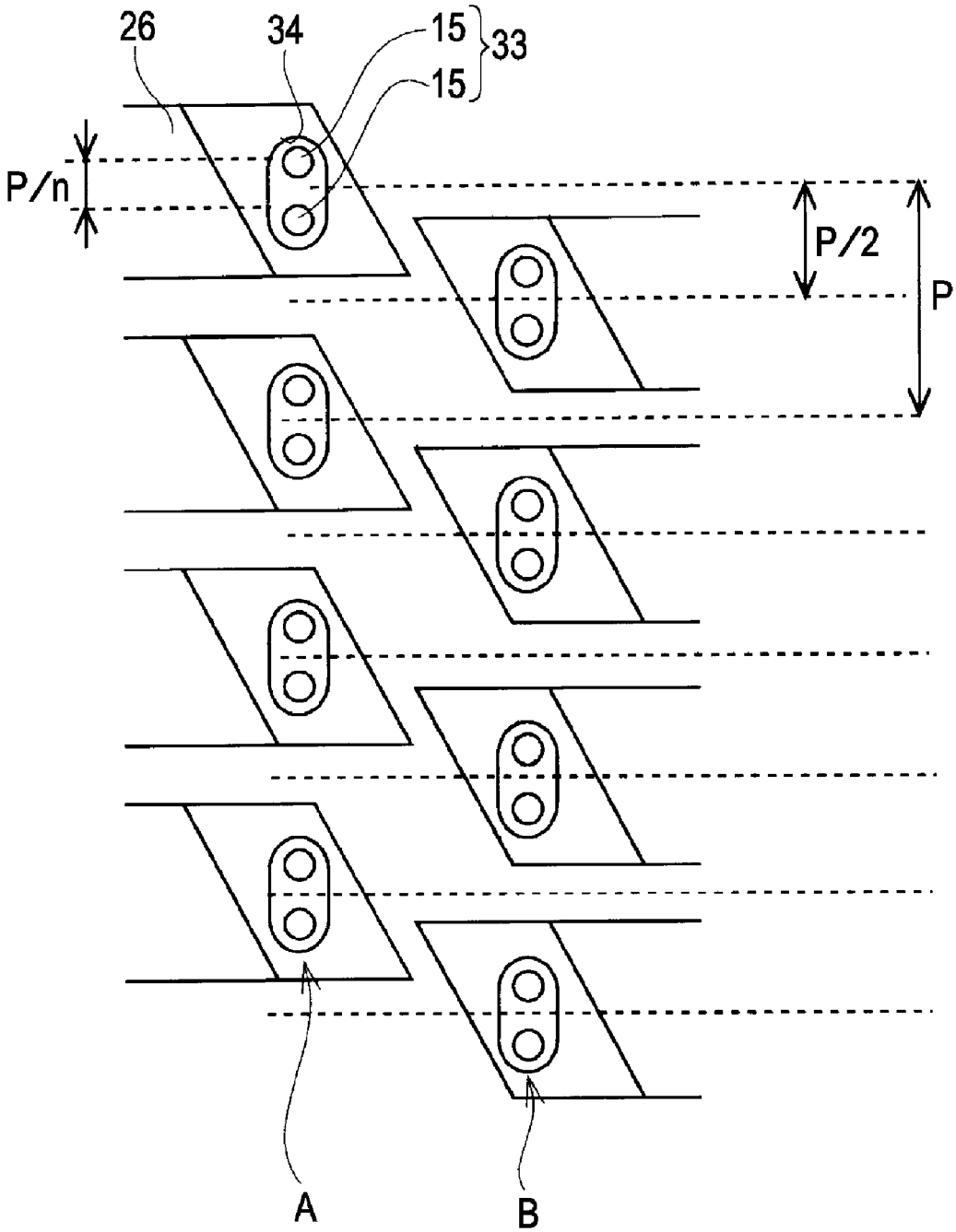
FIG. 8 is an explanatory illustration showing an arrangement of nozzle groups.

Next, a recording head 2 for the above-described printer 1 is described according to a first embodiment. FIG. 6 is a plan view showing a primary portion of the pressure chamber forming substrate 27. FIG. 7 is a cross section showing the passage unit 18 taken along line VII-VII (in FIG. 6). FIG. 8 is an explanatory illustration showing an arrangement of nozzle groups. As shown in FIG. 6, in the embodiment, the two adjacent nozzle openings 15 define the single nozzle set 33. The nozzle openings 15 of the nozzle set 33 are arranged along the sub-scanning direction. As shown in FIG. 8, the nozzle sets 33 of the single nozzle group are arranged in the sub-scanning direction at a regular pitch P, for example, corresponding to 180 dpi. The nozzle openings 15 of the nozzle set 33 are arranged at a pitch P/n (n: natural number) which is smaller than the regular pitch P. In the embodiment, the nozzle openings 15 are arranged in the sub-scanning direction (nozzle-set-array direction) at, for example, 720 dpi, or P/4. Nozzle groups include a first nozzle group A (one of the nozzle groups) and a second nozzle group B (another one of the nozzle groups) being adjacent to each other. Nozzle sets 33 of the first nozzle group A and nozzle sets 33 of the second nozzle group B are relatively shifted from each other in the nozzle-set-array direction (in the embodiment, the sub-scanning direction). In particular, the first nozzle group A and the second nozzle group B are arranged at the nozzle plate 28 in a staggered manner such that a shift amount therebetween is, for example, 360 dpi, or ½ of an arrangement interval P of the nozzle sets 33 of the single nozzle group. Hence, the nozzle openings 15 of the nozzle set 33 are arranged at 720 dpi (P/4) in the sub-scanning direction.

With the arrangement, even if it is difficult to reduce the width in the sub-scanning direction of the pressure generating chamber 26 and piezoelectric vibrator 20 due to the manufacturing requirement, or even if it is difficult to arrange the nozzle sets 33 in the single nozzle group at even intervals at a small pitch (with a high density) in the sub-scanning direction (nozzle-set-array direction), dots can be formed on a line at a constant interval (in the embodiment, 720 dpi) in the sub-scanning direction, merely by varying ejection timings during main-scanning between the first nozzle group A and the second nozzle group B without increasing the number of scanning operations (paths). This arrangement can make a contribution to an increase in recording speed.

As shown in FIG. 7, the island portions 42 of the vibrating plate 29, the piezoelectric vibrators 20 of the actuator unit 17, and the pressure generating chambers 26 are provided one by one. Adjacent nozzle openings 15 defining a single nozzle set 33 are provided for a pressure generating chamber 26. Referring to FIG. 7, the pressure generating chambers 26 corresponding to the nozzle set 33 are divided by a partition wall 54. As described above, since the nozzle set 33 including the plurality of nozzle openings 15 is arranged to correspond to the pressure generating chamber 26, it is not necessary to provide a pressure generating chamber 26 for each nozzle opening 15 unlike a related art. Concerning a nozzle group including an equivalent number of nozzle openings 15, the number of pressure generating chambers 26 corresponding to the nozzle openings 15 can be reduced (halved), as compared with a related art in which pressure generating chambers are provided for nozzle openings one by one. In other words, the number of nozzle openings 15 can be increased (doubled) without an increase in the number of piezoelectric vibrators 20 or pressure generating chambers 26. In the embodiment, a single nozzle group is defined by 360 nozzle openings 15, and the 360 nozzle openings 15 correspond to 180 pressure generating chambers 26, the number of which is a half of the number of the nozzle openings 15. Accordingly, the thickness of the partition wall 54 for dividing the pressure generating chambers 26 can be increased as compared with a related art in which the number of the pressure generating chambers 26 is equal to the number of the nozzle openings 15. As a result, the rigidity of the partition wall 54 can be increased as compared with a related art. Hence, an effect of a pressure wave generated by ejection operations of the adjacent pressure generating chambers 26 can be prevented. Therefore, a cross talk can be prevented, and an ejection characteristic can become stable.

Figure 5:
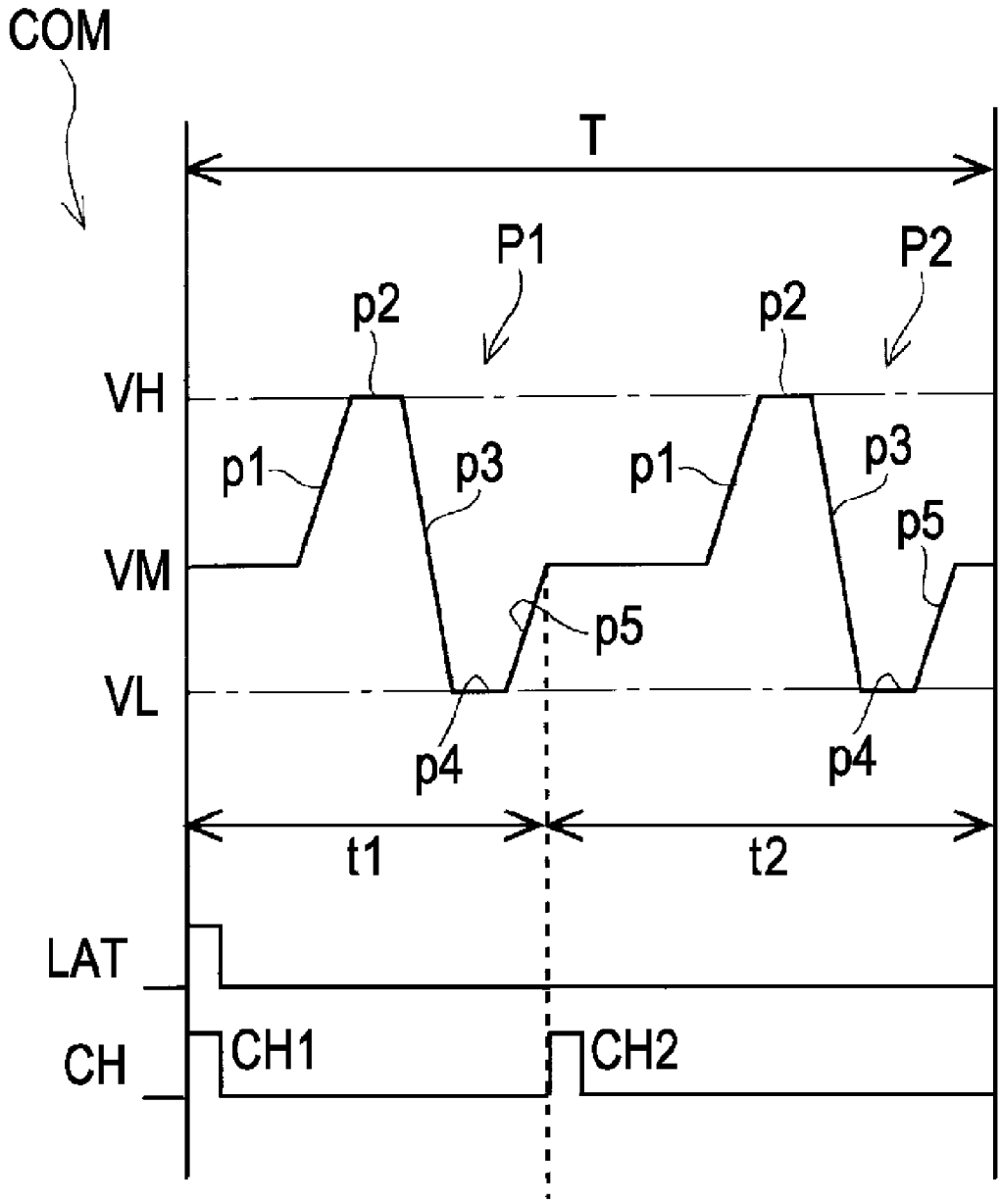
FIG. 5 is an explanatory illustration showing an arrangement of a driving signal.

Referring to FIG. 5, in the recording head 2 having the above-described configuration, when an ejection pulse is supplied to the piezoelectric vibrator 20 via the flexible cable 22, the expansion element p1 causes the piezoelectric vibrator 20 to be contracted in an element longitudinal direction and the island portion 42 is displaced in a direction away from the pressure generating chamber 26. Accordingly, the pressure generating chamber 26 as a driving target is expanded to an expansion volume corresponding to the high potential VH from a reference volume corresponding to the midpoint potential VM. With the expansion of the pressure generating chamber 26, ink is supplied to the pressure generating chamber 26 from the reservoir 30 through the ink supply port 31. The expansion state of the pressure generating chamber 26 is held during a supplying period of the expansion hold element p2.

Then, the ejection element p3 is supplied, so that the piezoelectric vibrator 20 is expanded and the island portion 42 is displaced in a direction toward the pressure generating chamber 26. Accordingly, the pressure generating chamber 26 is rapidly contracted from the expansion volume to a contraction volume corresponding to the low voltage VL. With the contraction of the pressure generating chamber 26, a pressure is applied to ink inside the pressure generating chamber 26, and ink droplets are ejected simultaneously from the nozzle openings 15 of the nozzle set 33 corresponding to the pressure generating chamber 26 of the driving target. The contraction state of the pressure generating chamber 26 is held during a supplying period of the contraction hold element p4. During the period, an internal pressure of the pressure generating chamber 26, the internal pressure being reduced because of the ejection of the ink droplets, is increased again because of a natural vibration. Following the increase timing, the damping element p5 is supplied. With the damping element p5, the pressure generating chamber 26 is expanded and recovered to the reference volume, and a pressure variation of the ink in the pressure generating chamber 26 is absorbed.

As described above, the unit pixel according to the embodiment is 360×360 dpi. Hence, to form a unit pixel on a recording sheet, it is necessary to fill an entire area of a square of 70×70 μm with dots. In a printer of a related art, to form a unit pixel on a recording sheet, dots with a diameter of about 100 μm circumscribing the square are formed. Also, in the related art, about 40 pl of ink is used for forming the dots. As mentioned above, a relatively large amount of ink is used to form a unit pixel in the related art. Accordingly, a deformation (roughness) may be generated at a recording sheet because of moisture contained in ink, or an ink bleed may be found at a recorded image. Also, if ink in an ink cartridge is consumed quickly, the ink cartridge has to be frequently replaced, thereby increasing the running cost, which is a burden to a user, and providing an adverse effect on the environmental conservation.

In light of the above situations, in the printer 1 according to the embodiment of the invention, a unit pixel on a recording sheet can be efficiently filled with dots by a reduced amount of ink.

Figure 10:
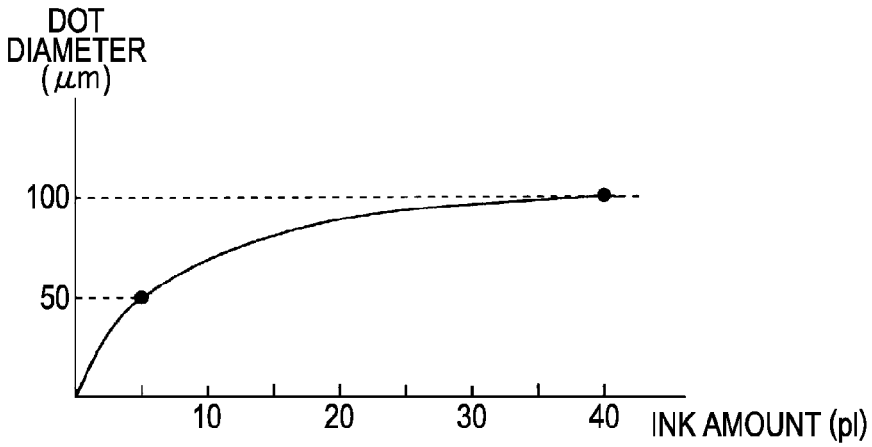
FIG. 10 is a graph showing a relationship between an ink amount and a dot diameter.

FIG. 10 is a graph showing a relationship between an amount of ink and a dot diameter. As shown in FIG. 10, a graph indicating a dot diameter to an amount of ink generally becomes nonlinear. It is found that an amount of ink necessary for forming a dot with a diameter of 100 μm is 40 pl, however, an amount of ink necessary for forming a dot with a diameter of 50 μm, which is a half of the former diameter, is not 20 pl, but 5 pl is enough.

Figure 9A:
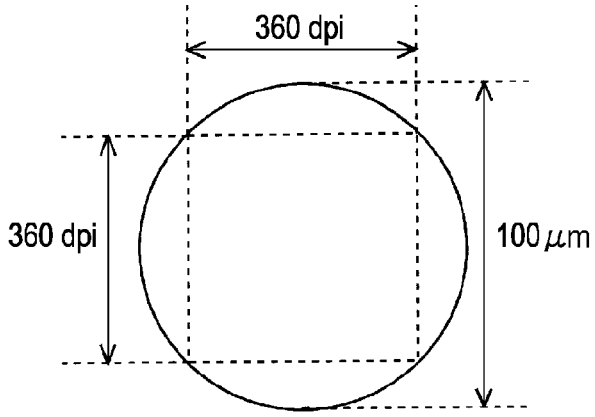
FIG. 9A is a schematic illustration showing an arrangement of a dot for forming a unit pixel according to a related art.
Figure 9B:
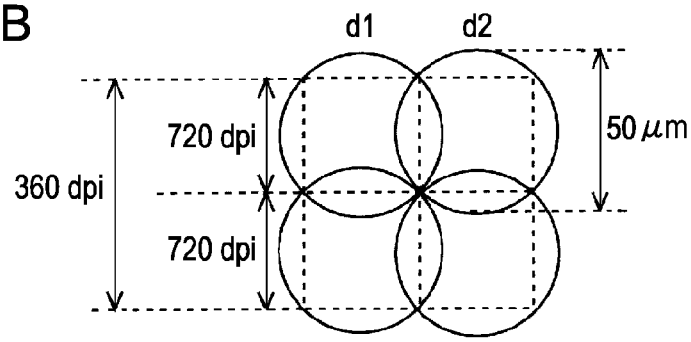
FIG. 9B is a schematic illustration showing an arrangement of dots for forming a unit pixel according to the first embodiment.

The printer 1 according to the embodiment of the invention utilizes the above finding. During a single recording period T, the first ejection pulse P1 is applied to the piezoelectric vibrator 20 so that ink droplets are ejected simultaneously from the nozzle openings 15 of the nozzle set 33 corresponding to the pressure generating chamber 26 of the driving target by 5 pl each, thereby as shown in FIG. 9B, forming dots with a diameter of 50 μm each arranged in the sub-scanning direction at 720 dpi on the recording sheet 6. Accordingly, a half of the unit pixel (a half in the main-scanning direction) is filled with a set of two dots (dot elements d1). Next, the second ejection pulse P2 is applied to the piezoelectric vibrator 20, so that ink droplets are ejected respectively from the nozzle openings 15. Accordingly, the residual half of the unit pixel is filled with a set of two dots (dot elements d2) arranged in the sub-scanning direction. That is, the unit pixel of the embodiment is formed by the four dots containing ink droplets of 5 pl each.

With this configuration, the unit pixel can be formed by an amount of ink of 5 pl×4=20 pl. Therefore, the unit pixel can be formed by a substantially half amount of ink as compared with a related art. Also, since a plurality of dots can be formed by a single ejection operation, a dot forming density in the sub-scanning direction according to the embodiment is apparently doubled as compared with the related art to which the invention is not applied. For solid printing in which a predetermined area on the recording sheet 6 is filled with dots without a blank, the number of scanning operations (paths) of the recording head 2 would not be increased.

Next, an advantage of the embodiment of the invention is verified in terms of a density of a unit pixel.

Figure 11:
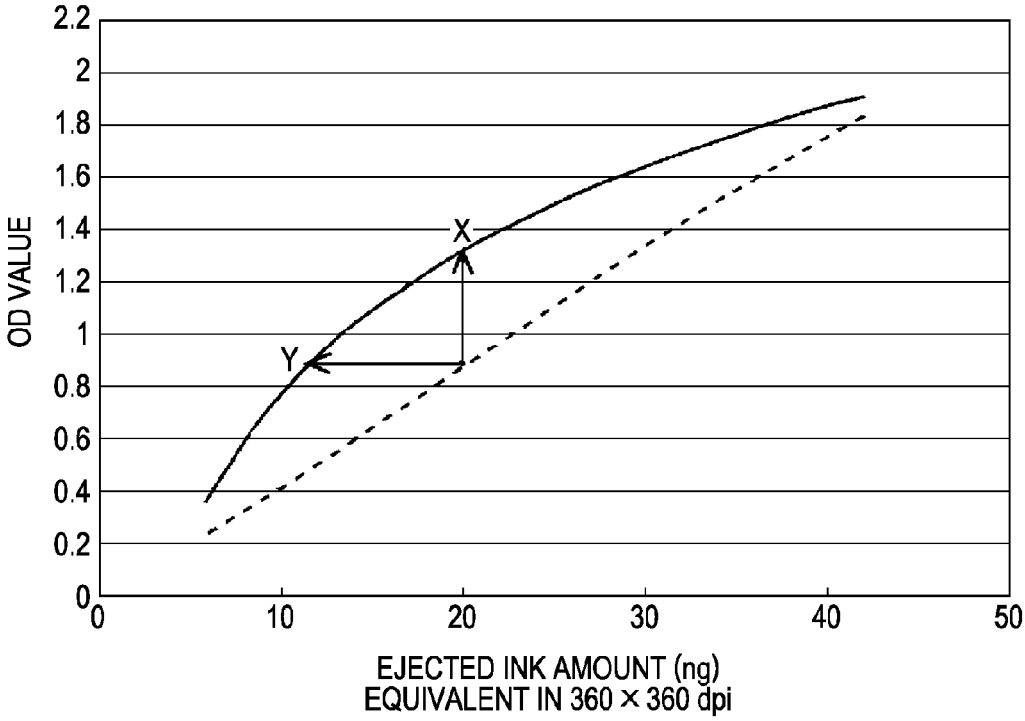
FIG. 11 is a graph showing a relationship between an ink amount to be ejected for a unit pixel and a density of ink of the unit pixel.

FIG. 11 is a graph showing a relationship between an amount of ink to be ejected for a unit pixel and a printing density of the unit pixel. In FIG. 11, a graph indicated by a solid line plots an experimental result of a configuration according to the embodiment of the invention (in which a plurality of nozzles correspond to a pressure generating chamber), whereas a graph indicated by a broken line plots an experimental result of a configuration of a related art (in which a nozzle corresponds to a pressure generating chamber). As shown in FIG. 11, in the configuration of the related art, an optical density (OD) value that represents a printing density of a unit pixel is linearly increased in accordance with an increase in amount of ejection ink. In contrast, in the configuration of the embodiment of the invention, an OD value is logarithmically increased in accordance with an increase in amount of ejection ink.

In a range of an ink-ejection amount for covering a predetermined area with ink (dots) without a blank, for example, as indicated by arrow X in FIG. 11, an OD value when an equivalent amount of ink is ejected according to the embodiment of the invention is larger than an OD value according to the related art. Also, as indicated by arrow Y, an ejection amount of ink for obtaining an equivalent OD value according to the embodiment of the invention is smaller than an ejection amount according to the related art. This is because, when a predetermined area is filled with a plurality of droplets of ink, the ink may spread in a larger area than a case where the predetermined area is filled with a droplet of ink, or a dot. Thus, a covering area with ink becomes larger. Accordingly, with the embodiment of the invention, a predetermined area on an ejection target can be efficiently filled with ink. In particular, the embodiment of the invention is suitable for forming an image with a gray scale that expresses a gradation with a shade of ink.

As described above, in the printer 1 with the above-mentioned recording head 2 mounted, the single pressure generating chamber 26 corresponds to the single nozzle set 33 having a set of the plurality of nozzle openings 15 being adjacent to each other in the sub-scanning direction. Accordingly, ink droplets can be ejected from the nozzle openings 15 of the nozzle set 33 corresponding to the pressure generating chamber 26 of the driving target by a single ejection operation (discharge operation). Hence, a predetermined area on a recording sheet (ejection target) can be efficiently filled with dots using the ink droplets ejected from the nozzle openings 15 by an amount of ink smaller than that of the related art. Thus, ink consumption, that is, a total amount of ink landing on a recording sheet when an image or the like is recorded can be reduced. As a result, a deformation of the recording sheet because of moisture contained in the ink, or an ink bleed of a recorded image can be prevented. Also, since the ink consumption is reduced, the running cost can be reduced and a contribution to the environmental conservation can be made.

With the embodiment of the invention, it is not necessary to change a formation pitch of the piezoelectric vibrators 20, and the piezoelectric vibrators 20 having an existing configuration can be used, thereby being convenient. Also, the size of the individual piezoelectric vibrator 20 is not changed, and hence, the displacement efficiency is not deteriorated.

The invention is not limited to the above-described embodiment, and may include various modifications within the scope of claims.

Figure 12:
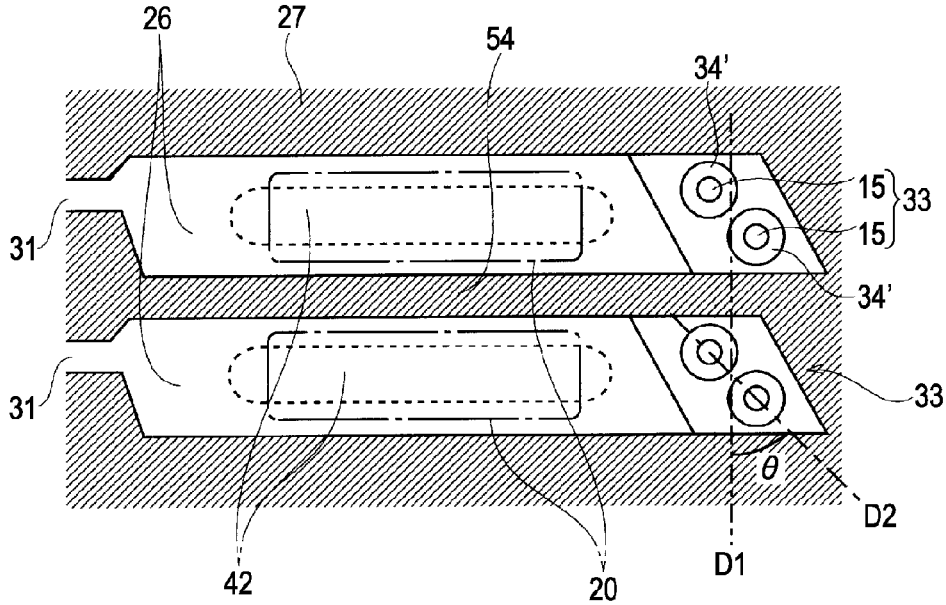
FIG. 12 is a plan view showing a primary portion of a configuration of a passage forming substrate according to a second embodiment of the invention.
Figure 13:
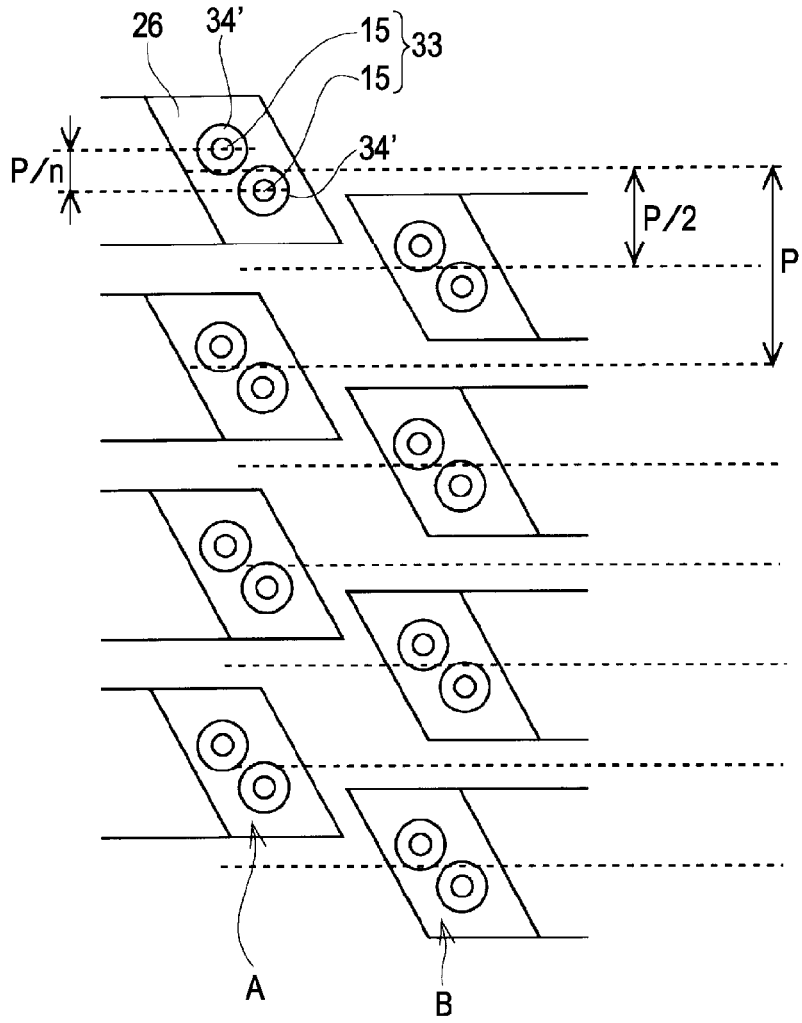
FIG. 13 is an explanatory illustration showing an arrangement of nozzle groups according to the second embodiment.

FIG. 12 is a plan view showing a primary portion of a pressure chamber forming substrate 27 according to a second embodiment of the invention. FIG. 13 is an explanatory illustration showing an arrangement of nozzle groups according to the embodiment.

As shown in FIG. 12, the second embodiment is similar to the first embodiment in that two adjacent nozzle openings 15 define a single nozzle set 33, however, an arrangement of nozzle openings 15 defining a nozzle set 33 is different. In particular, the nozzle openings 15 defining the nozzle set 33 are arranged along the nozzle-set-array direction (sub-scanning direction) according to the first embodiment, whereas the nozzle openings 15 defining the nozzle set 33 are arranged obliquely to the nozzle-set-array direction (sub-scanning direction) according to the second embodiment. The arrangement direction of the nozzle openings 15 is at an angle of 45° to the nozzle-set-array direction. In other words, an imaginary line D2 connecting the centers of the nozzle openings 15 is at an angle θ of 45° to an imaginary line D1 connecting the centers of the nozzle sets 33 of the single nozzle group.

As shown in FIG. 13, the nozzle sets 33 of the single nozzle group are arranged in the sub-scanning direction at a regular pitch P in a manner similar to the first embodiment. Also, an arrangement interval of the nozzle openings 15 defining the nozzle set 33 in the nozzle-set-array direction is P/n (n: natural number). In the embodiment, the arrangement interval of the nozzle openings 15 in the nozzle-set-array direction is 720 dpi, or P/4. Nozzle groups include a first nozzle group A and a second nozzle group B being adjacent to each other. Nozzle sets 33 of the first nozzle group A and nozzle sets 33 of the second nozzle group B are relatively shifted from each other in the nozzle-set-array direction. In the embodiment, the first nozzle group A and the second nozzle group B are arranged at the nozzle plate 28 in a staggered manner such that a shift amount therebetween is, for example, 360 dpi, or ½ of the arrangement interval P of the nozzle sets 33 of the single nozzle group. Hence, the nozzle openings 15 of both nozzle groups are arranged at 720 dpi (P/4) in the sub-scanning direction.

As described above, since the nozzle openings 15 defining the nozzle set 33 are arranged obliquely to the nozzle-set-array direction (sub-scanning direction), an interval between the nozzle openings 15 of the single nozzle set 33 can be increased without changing an arrangement interval of the nozzle openings 15 in the nozzle-set-array direction, or a recording density (basic resolution) in the sub-scanning direction. In particular, since the nozzle openings 15 are arranged such that the arrangement direction of the nozzle openings 15 is oblique to the nozzle-set-array direction by 45°, the interval of the nozzle openings 15 can be maximized in a minimum space. Accordingly, the nozzle openings 15 can be further easily formed by pressing the nozzle plate 28 made of metal. In particular, when the nozzle openings 15 are closely arranged, for example, an adverse effect (deformation of bore diameter) may be provided due to a flow (thickness unevenness) of a nozzle plate base material during pressing. Such an adverse effect, however, can be reduced by increasing the interval between the nozzle openings 15 as much as possible.

By increasing the interval between the nozzle openings 15 of the single nozzle set 33, a flying bend of ink when the ink is ejected from the nozzle openings 15 can be reduced. In particular, when ink droplets are ejected simultaneously from the nozzle openings 15 of the single nozzle set 33, the ink droplets may repel each other, and hence flying directions of the ink droplets may be bent. This is because, for example, an air resistance between the ink droplets is different from an air resistance of the periphery. Thus, the ink droplets may fly to the side with a smaller resistance. In this situation, an adverse effect caused by the close arrangement of the ink droplets can be prevented by increasing an interval between the nozzle openings 15 as much as possible. Accordingly, the flying bend of the ink can be reduced.

Figure 14:
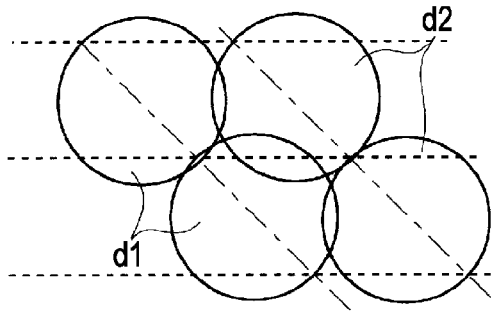
FIG. 14 is a schematic illustration showing an arrangement of dots according to the second embodiment.

Further, when the ink is ejected from the nozzle openings 15 of the single nozzle set 33, as shown in FIG. 14, dot elements including two dots are formed on a recording sheet 6 obliquely (at an angle of 45° in the embodiment of FIG. 14) to the nozzle-set-array direction (sub-scanning direction). Since the dots are formed obliquely, a predetermined area can be evenly filled with the ink. In particular, in the configuration in which the dots are arranged in the nozzle-set-array direction, a predetermined area can be easily filled with the ink in that direction, however, it is difficult to fill the predetermined area with the ink in a direction orthogonal to that direction because an interval of dots is possibly changed in accordance with a timing of ink ejection and a flying direction of the ink. In contrast, since the dots are provided obliquely to the nozzle-set-array direction, a predetermined area can be filled with the dots evenly in the nozzle-set-array direction and the direction orthogonal thereto.

Also, in the embodiment, the nozzle plate 28 is recessed to an intermediate position in a thickness direction of the nozzle plate 28 so as to form a recessed portion 34' (second nozzle) having a circular shape in plan view individually for each nozzle opening 15. The recessed portion 34' is a circular recess in plan view having a larger inner diameter than an inner diameter of the nozzle opening 15. The nozzle opening 15 is bored at the center of a bottom portion of the recessed portion 34'. That is, the recessed portion 34' contains a corresponding nozzle opening 15. Since the recessed portion 34' is provided individually for each nozzle opening 15, the nozzle openings 15 may have a uniform peripheral shape. Accordingly, a flying bend of ink ejected from the nozzle openings 15 can be reduced. Alternatively, the embodiment may employ a recessed portion 34 shared by nozzle openings 15 defining a single nozzle set 33 in a manner similar to the first embodiment.

In the above-described embodiments, while the nozzle openings 15 have a uniform opening diameter, it is not limited thereto, and individual nozzle openings 15 may have different diameters. For example, an opening diameter of nozzle openings 15 of a first nozzle group may be smaller than an opening diameter of nozzle openings 15 of a second nozzle group, so that ink droplets may be ejected from the nozzle openings 15 of the first nozzle group when small dots are to be formed, and ink droplets may be ejected from the nozzle openings 15 of the second nozzle group when large dots are to be formed. Accordingly, a recording speed can be increased, and also, an image quality of a recording image can be increased.

Also, in the above-described embodiments, while a set of the two nozzle openings 15 being adjacent to each other in the sub-scanning direction define a nozzle set 33, it is not limited thereto. For example, a set of three or more nozzle openings 15 being adjacent to each other in the sub-scanning direction may define a nozzle set 33.

Also, in the above-described embodiments, while the pressure generating unit is the piezoelectric vibrator 20 of length-extension vibration mode, which is a kind of electromechanical converter, it is not limited thereto. The pressure generating unit may be a piezoelectric vibrator of flexural vibration type or a magnetostrictive element, which is also a kind of electromechanical converter, or a heating element, which is a kind of electrothermal converter.

Further, the invention may be applied to a liquid ejecting apparatus configured to eject liquid while a long liquid ejecting head (line liquid ejecting head), in which nozzle openings are arranged so as to correspond to a maximum recording width of a recording medium at a predetermined pitch, is fixed relative to an apparatus body.

In the above description, while the liquid ejecting head employs the ink jet recording head 2, the invention may be applied to other liquid ejecting head. The invention may be applied to a color material ejecting head used for manufacturing color filters of, for example, liquid crystal displays; an electrode material ejecting head used for forming electrodes of, for example, organic electro luminescence (EL) displays, and field emission displays (FEDs); a living organic material ejecting head used for manufacturing biochips (biochemical elements); and the like.

Further, the invention may be applied to a liquid ejecting apparatus other than the above-described printer. For example, the invention may be applied to a display manufacturing apparatus, an electrode manufacturing apparatus, a chip manufacturing apparatus, or the like.

The entire disclosure of Japanese Patent Application Nos. 2007-144931, filed May 31, 2007 and 2008-003218, filed Oct. 1, 2008 are expressly incorporated by reference herein.

What is claimed is:

1. A liquid ejecting head comprising:

a plurality of nozzle groups each including a plurality of nozzle openings; and a plurality of pressure generating units that cause liquid to be ejected from the plurality of nozzle openings, where each of the plurality of pressure generating units includes a piezoelectric vibrator;

wherein a plurality of recessed portions are formed at a surface of a nozzle forming member which is adjacent to the pressure generating units, the recessed portions each having a thickness smaller than a thickness of thick portions of the nozzle forming member, such that the recessed portions do not extend to a nozzle surface of the nozzle forming member where the nozzle openings are formed, the nozzle openings being formed so as to communicate with the recessed portions, wherein a set of at least two of the plurality of nozzle openings included in each single nozzle group defines a nozzle set, the nozzle set being arranged to correspond to each of the pressure generating units, wherein a single pressure generating unit causes liquid to be ejected from the at least two of the plurality of nozzle openings in the single nozzle group, and wherein the nozzle groups each have a plurality of nozzle sets in an array, the nozzle sets of one of the nozzle groups being relatively shifted from the nozzle sets of another one of the nozzle groups in a nozzle-set-array direction.

2. The liquid ejecting head according to claim 1, wherein the nozzle openings defining the single nozzle set are arranged obliquely to the nozzle-set-array direction.

3. The liquid ejecting head according to claim 2, wherein an arrangement direction of the nozzle openings defining the single nozzle set is at an angle of 45° to the nozzle-set-array direction.

4. The liquid ejecting head according to claim 1, wherein a shift amount between the nozzle sets of one of the nozzle groups and the nozzle sets of another one of the nozzle groups is ½ of an arrangement interval P of the nozzle sets of the nozzle groups.

5. The liquid ejecting head according to claim 1, wherein an arrangement interval P of the nozzle openings defining the single nozzle set in the nozzle-set-array direction is P/n, where n is a natural number.

6. The liquid ejecting head according to claim 5, wherein n=4.

7. The liquid ejecting head according to claim 1, wherein each of the recessed portions is provided for each of the nozzle sets so as to contain the nozzle openings defining the single nozzle set.

8. The liquid ejecting head according to claim 1, wherein each of the recessed portions is provided individually for each of the nozzle openings.

9. The liquid ejecting head according to claim 1, wherein the pressure generating unit is an electromechanical converter or an electrothermal converter.

10. A liquid ejecting apparatus comprising: the liquid ejecting head according to claim 1.

* * * * *